US005344138A

United States Patent [19]

Hellriegel

[11] Patent Number: 5,344,138

[45] Date of Patent: Sep. 6, 1994

[54] TENNIS TRAINING APPARATUS

[76] Inventor: Ernst W. Hellriegel, 367A Fantail Loop NE., Austin, Tex. 78734

[21] Appl. No.: 715,356

[22] Filed: Jun. 14, 1991

[30] Foreign Application Priority Data

Nov. 15, 1990 [ZA] South Africa ..... 90/9156

[51] Int. Cl.[5] ..... A63B 61/00

[52] U.S. Cl. ..... 273/29 A

[58] Field of Search ..... 273/29 R, 29 A, 188 A, 273/200 R, 200 B, 183 A, 187.1, 195 R, 187 R, 183.1, 26 R

[56] References Cited

U.S. PATENT DOCUMENTS

| | | | |
|---|---|---|---|
| 2,941,808 | 6/1960 | Smith et al. | 273/183 A |
| 3,051,491 | 8/1962 | Cabot | 273/200 R |
| 3,658,330 | 4/1972 | Maestracci | 273/29 A |
| 3,658,344 | 4/1972 | Kimble | 273/187 R |
| 3,899,179 | 8/1975 | Vlach | 273/187.1 |
| 3,918,711 | 11/1975 | Zak | 273/29 A |
| 3,918,712 | 11/1975 | Fey et al. | 273/58 C |
| 4,000,905 | 1/1977 | Shirhall | 273/187 A |
| 4,023,798 | 5/1977 | Pronin | 273/29 A |
| 4,194,735 | 3/1980 | Wilson | 273/26 R |
| 4,258,916 | 3/1981 | Beam | 273/26 R |
| 4,270,757 | 6/1981 | Ligon | 273/411 |
| 4,502,685 | 3/1985 | Phillips | 273/29 A |
| 4,544,159 | 10/1985 | Sells | 273/187.1 |
| 4,647,048 | 3/1987 | Welch | 273/188 A |
| 4,662,641 | 5/1987 | Peyret, Jr. | 273/200 B |
| 4,915,387 | 4/1990 | Baxstrom | 273/187 A |

FOREIGN PATENT DOCUMENTS

| | | | |
|---|---|---|---|
| 8900441 | 1/1989 | Australia | 273/29 A |

*Primary Examiner*—Theatrice Brown

*Attorney, Agent, or Firm*—Jeffrey D. Myers; Deborah A. Peacock; Donovan F. Duggan

[57] ABSTRACT

An apparatus for training the overhead service in tennis. The apparatus comprises indicators of a target base area and of correct feet placement, a connecting member between the two indicators, and, optionally, a flexible connecting member between the target base area indicator and a tennis ball.

42 Claims, 2 Drawing Sheets

TENNIS TRAINING APPARATUS

BACKGROUND OF THE INVENTION

1. Field of the Invention (Technical Field)

This invention relates to a tennis training apparatus. More particularly, the invention relates to an apparatus suitable for training the overhead service in tennis.

2. Background Art

Those acquainted with the game will appreciate that the service in tennis is of the utmost importance, firstly, for a casual player who intends having an enjoyable game of tennis, and secondly, more importantly, for a more serious player who intends winning. Tossing the tennis ball and feet placement are essential for a good service. As the toss is the most important part of the service, it follows that if a player can obtain and maintain consistency in the toss, a higher percentage of first services will go into the service court.

For the tennis overhead service, an optimum toss height and position exists. For a right-handed player, this height and position can be visualized as contained in an imaginary cylinder of space out to his right in front. Furthermore, this optimum height and position define the ideal point where a racket, on the stroke during serving, should connect the tennis ball. This ideal point will be called the target, while the target base area is the base of the imaginary cylinder, this base necessarily being on the ground. Consistency in the toss implies that a tennis ball should each time be tossed to the target. Should the tennis ball be allowed to drop from the target, it will land in the target base. Mainly three aspects are of relevance to the service, namely, the player's grip of the racket, his shoulders, and the toss. Any deviation from the target will cause the player to compensate for the bad toss. When the right-handed player, for example, tosses the ball too far to his left, his shoulders open too soon resulting in an incorrect angle. Consequently, a continental serving grip, which is considered the correct serving grip, becomes a semi-western grip in order to get the tennis ball in the service court. Such a toss impairs the serving power due to the shoulders and body weight pulling away, instead of going through the target. As for the toss, optimum feet placement is essential, said placement giving a good indication of the flight path of the tennis ball having been served. A need thus exists for an apparatus designed to give a better understanding of the toss and feet placement.

SUMMARY OF THE INVENTION

Disclosure of the Invention

According to the invention, there is provided an apparatus suitable for training a tennis service, comprising:

indicating means for indicating a target base area;

a positioning means for correct feet placement;

a connecting member for inter-connecting the indicating and positioning means, and, optionally joining means for joining a tennis ball or the like to the indicating means.

Preferably, the toss target base area indicating means are ring shaped. In this context, it will be appreciated that any suitable circle-shaped means will suffice to indicate the target base area. Conveniently, the target base area has a diameter of approximately 355 mm (14 inches); the area may lie between 150 mm and 500 mm. Preferably, the target base area indicating means are provided with anchoring means for anchoring the indicating means to the ground. Conveniently, these anchoring means are protrusions, e.g., like a spike or a peg.

The positioning means for correct feet placement preferably comprise an elongate member and two pairs of shortened members connectable to either side of the elongate member at suitable angles thereto. The connections may be established by fitting the members into or through holes provided in or extending through the elongate member. Conveniently, the members of each pair of shortened members are spaced apart along the elongate member so that a foot may be placed in between the two members of a pair of shortened members. Still more conveniently, the two pairs of shortened members are spaced apart along the elongate member. The pairs so spaced will allow a tennis player to take a suitable stance while the serve is trained. As the shortened members are connectable to the elongate member, said stance may be varied to the liking of the tennis player. As an alternative to the two pairs of shortened members, suitable plates, being platforms on which the feet may be placed, may be employed.

Preferably, the elongate member is adapted to be filled with sand or water to weigh it down to the ground. Alternatively, the elongate member may be provided with anchoring means for anchoring it to the ground conveniently. These anchoring means may be protrusions, such as a spike or a peg. The applicant has found that an elongate member having a length of approximately 787 mm (31 inches) will suffice. Members between 500 mm and 1,000 mm will be convenient.

Preferably, the connecting member for inter-connecting the indicating and positioning means is pivotally connected to each of these means. These connections allow the indicating and positioning means to be movable relatively to each other, thus allowing adjustment of the indicating means to both sides of the positioning means to accommodate both left-handed and right-handed players. Conveniently, the connecting member is adapted to allow the indicating means to be adjustable towards and away from the positioning means. Still more conveniently, the connecting member is provided with holes in or extending through it to accommodate a pivot. The pivot connecting the indicating means and connecting member may be removable. Consequently, the indicating means being in a position relative to the positioning means may be disconnected from the connecting member and moved towards or away from the positioning means and reconnected to the connecting member using the removed pivot inserted in or through a hole in the connecting member.

Preferably, the connection connecting the positioning means to the connecting member is provided with fastening means to prevent the connecting member from moving around during serving.

Preferably, the connecting means for connecting the tennis ball or the like to the indicating means is an elastic cord. In one embodiment of the invention, this cord is adjustable to the optimum toss height. Should the tennis ball be tossed too high, it will merely return towards the ground through the target, thus allowing the tennis player to strike the ball when at the target. In another embodiment of the invention, the cord is adjustable in such a way to allow the tennis ball to be served into the service court and to return the ball to the player.

In an alternative embodiment, the positioning means comprises a single plate on which the tennis player stands. Marks thereon indicate correct placement of the forward foot, correct placement of the rear foot (preferably indicating a plurality of possible placements of the rear foot, the correct placement varying upon the tennis player's shoulder width), correct placement of the connecting member for a flat serve, for a spin serve, for a slice serve and for a kick serve, and correct placement of the plate with respect to a tennis court's service line.

In the alternative embodiment, the plate may comprise an obverse side having marks indicating correct positionings for a right-handed service and a reverse side having marks indicating correct positionings for a left-handed service or an obverse side having marks indicating correct positionings for a service into a right service court and a reverse side having marks indicating correct positionings for a service into a left court.

Either embodiment may additionally comprise a net for stopping tennis balls served into it. A connector may removably attach the indicating means and the connecting member. Preferably, the connector is flush with or below the surface of the indicating means.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENTS

Best Modes for Carrying out the Invention

The present invention relates to a tennis training apparatus for training the overhead service in tennis.

Figure 1:
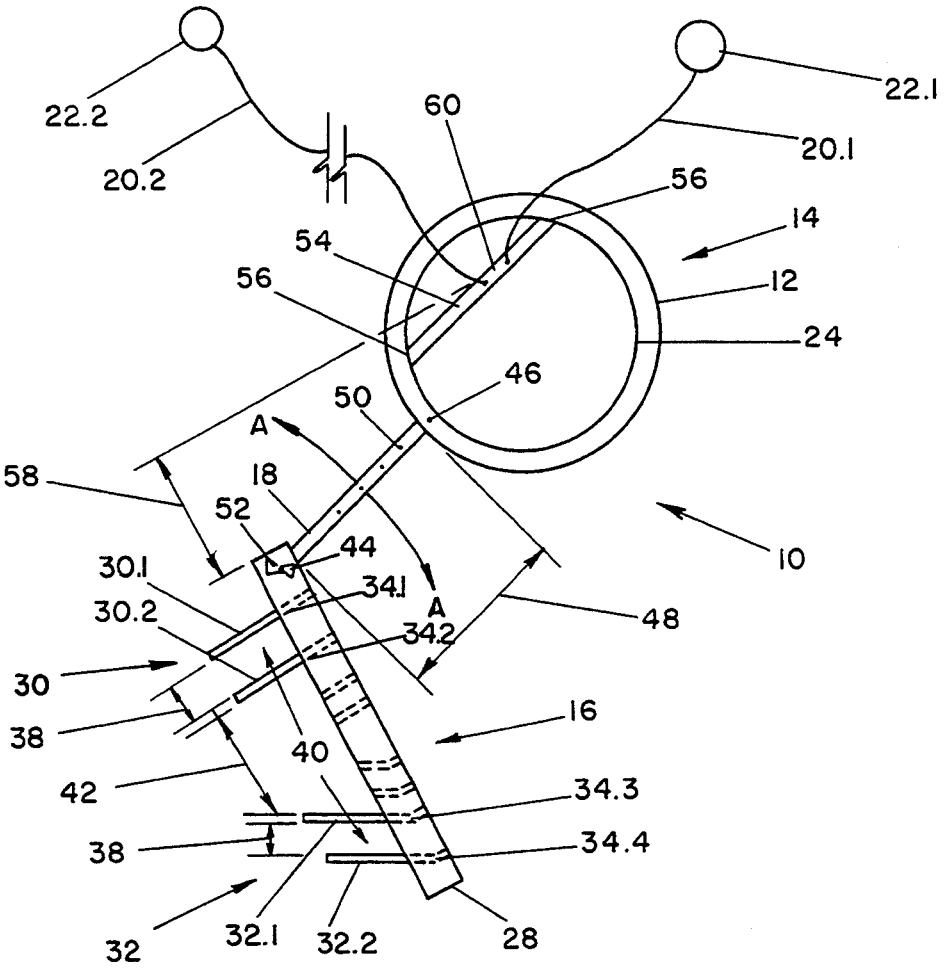
FIG. 1 is a plan view of the preferred tennis training apparatus of the invention.
Figure 2:
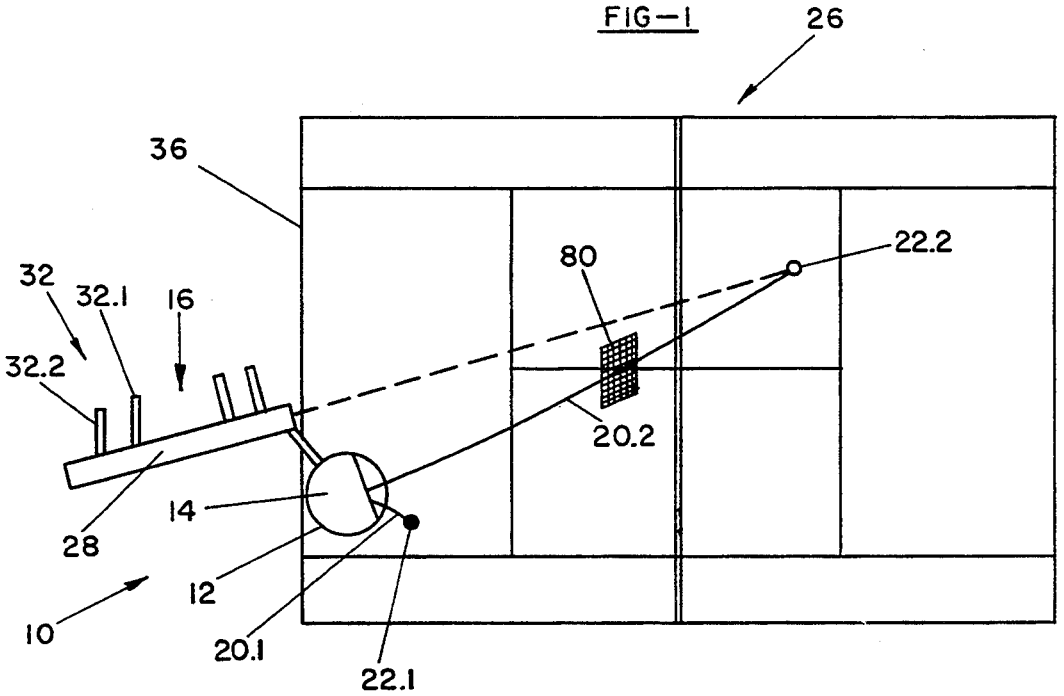
FIG. 2 is a plan view of the preferred tennis training apparatus and a tennis court, the apparatus being in a recommendable position for a right-handed tennis player.

Reference is now made to FIGS. 1 and 2 which illustrate the preferred embodiment of the invention. In the drawings, reference numeral 10 generally indicates a tennis training apparatus in accordance with a preferred embodiment of the invention. The tennis training apparatus 10 comprises an indicating means 12 for indicating a target base area 14, a positioning means 16 for correct feet placement, a connecting member 18 for inter-connecting the indicating means 12 and the positioning means 16, and joining means 20.1 and 20.2 for joining a tennis ball 22.1 and 22.2 to the indicating means 12.

The indicating means 12 for indicating the target base area 14 is ring shaped, the ring 12 having a diameter of 355 mm (14 inches). The ring 12 is manufactured from a pipe with its ends 24 welded to each other. Spikes (not shown) are provided on the ring's surface, which faces the surface of the tennis court 26. In this way, the ring 12 is anchored to the surface of the tennis court 26. It will be appreciated that the configuration of these spikes may vary due to the type of surface on to which the apparatus 10 is placed.

The positioning means 16 for correct feet placement comprises an elongate member 28 and two pairs of shortened members 30 and 32. The members 30.1, 30.2, 32.1, and 32.2 are connected to the elongate member 28 by snugly fitting each of these members 30.1, 30.2, 32.1, and 32.2 into holes 34.1, 34.2, 34.3, and 34.4, respectively, which are drilled into one side of the elongate member 28. The holes 34.3 and 34.4 are drilled at angles so that the members 32.1 and 32.2, when fitted into the holes, are parallel to a base line 36 of the tennis court 26 when the apparatus 10 is in use. The corresponding holes (shown in dotted lines) are drilled onto the opposite side of the elongate member 28 when the apparatus 10 is used by a left-hand player. The members 30.1 and 30.2 of the pair 30 are spaced apart at a distance 38 along the elongate member 28, as are the members 32.1 and 32.2 of the pair 32, so that a foot (not shown) may be placed in the space 40. To provide a suitable stance while training the service, the pairs of shortened members 30 and 32 are spaced apart at a distance 42 along the elongate member 28.

The elongate member 28 is a pipe filled with sand (not shown) to weigh it down to the surface of the tennis court 26.

The connecting member 18 inter-connecting the ring 12 and the elongate member 28 is connected thereto with pivots 44 and 46. The ring 12 and elongate member 28 are thus movable relatively to each other. Adjustment of the ring 12 to both sides of the elongate member 28 is thus possible. The pivot 46 connecting the ring 12 and connecting member 10 is removable, thus allowing the ring 12 to be disconnected from the connecting member 18 and to be moved towards or away from the elongate member 28. Having selected the distance 48 between the elongate member 28 and the ring 12, the ring 12 is reconnected to the connecting member 18 by inserting the pivot 46 into a hole 50 drilled into the connecting member 18. The pivot 44 is provided with a fly nut 52 which fastens the connecting member 18 to the elongate member 28.

The tennis ball 22.1 is connected to an elastic cord 20.1, which is connected to a metal strip 54 located in the target area 14. The ends 56 of this metal strip 54 are welded to the ring 12. The cord 20.1 is adjustable to the optimum toss height.

Another cord 20.2 is provided which connects a second tennis ball 22.2 to the metal strip 54. This cord is adjustable in such a way to allow the tennis ball to be served into the service court and to return the ball to the tennis player.

From the above description, it will be appreciated that the adjustability of the tennis training apparatus 10 allows it to be used by either right- or left-handed players, even if such a player is quite young.

In use, the tennis training apparatus 10 is placed on to the surface of the tennis court 36, with the ring 12 in front of the base line 36 and the elongate member 28 behind the base line 36. The elongate member 28 is directed towards the center of the service court and the pair of shortened members 32 parallel to the base line 36. The end of the elongate member 28, which is provided with the fly nut 52, may be placed against the base line 36.

Subsequently, the distance 42 between the members 30.2 and 32.1 of the two pairs of shortened members 30 and 32 is set for an initial stance. The distance 38 between the members 30.1 and 30.2 of the pair 30 and the distance 38 between the members 32.1 and 32.2 of the pair 32 are also set to accommodate the tennis player's feet. Subsequently, the distance 48 along the connecting member 18 is set by removing the pivot 46, moving the ring 12 towards or away from the elongate member 28 and inserting the pivot 46 into the required hole 50. The application has found an initial distance of 254 mm (12 inches) appropriate. The distance 58 between the end of the elongate member 28, which is provided with the fly nut 52 and a line projected from the point 60 to which the elastic cord 20.1 and 20.2 is connected, is set by unfastening the fly nut 52 and then adjusting the connecting member 18 and ring 12 in the required direction as indicated by the Arrows A—A. The fly nut 52 is fastened. The applicant has found this distance 58 to vary from 203 mm to 304 (8 to 12 inches). The tennis player may adjust the tennis training apparatus 10 accordingly.

Figure 3:
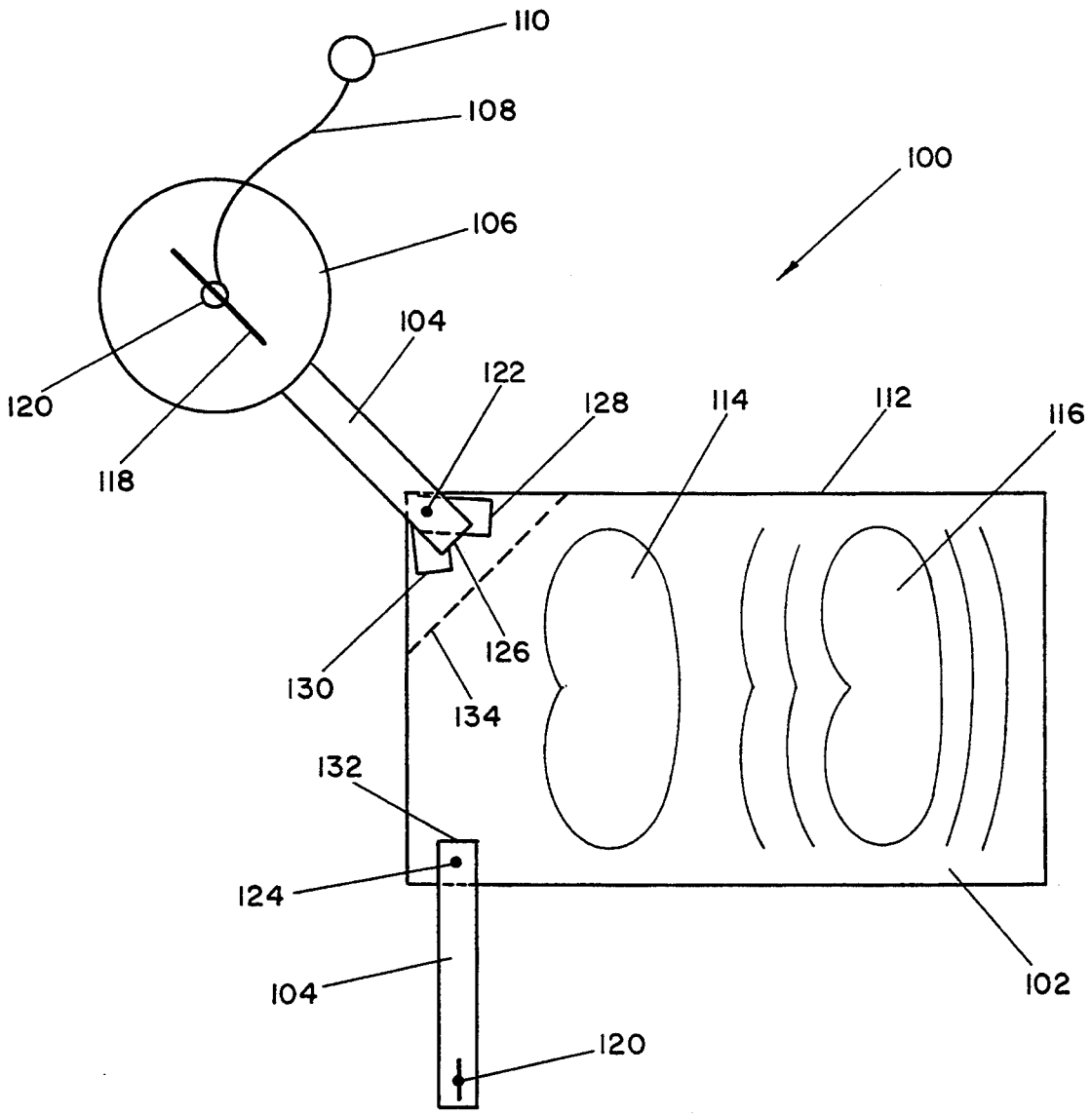
FIG. 3 is a plan view of an alternative tennis training apparatus of the invention.

FIG. 3 depicts an alternate embodiment of the invention 100. A tennis player stands on plate 102 of, for example, metal or durable plastic which comprises a lead foot label 114 and a rear foot label 116. Rear foot label 116 may show alternate positions for correct rear foot placement, the position being chosen by the tennis player based on his or her shoulder width. Connecting shaft 104 is connected at one of two positions, for a standard service and kick service, respectively, by connector 122 or connector 124. Base area indicator 106 is removably attached to connecting shaft 104 by connector 120. Preferably, connector 120 when engaged is flush with or below the surface of base area indicator 106 to prevent odd bounces by balls striking the base area indicator 106. The distance from the plate 102 is adjustable according to arm length by a slot 118 provided in base area indicator 106 through which it is attached to connecting shaft 104. Ball 110 may be removably attached to base area indicator 106 by elastic 108, as with the embodiment earlier presented.

For a service into the right court, plate 102 is placed on a tennis court such that alignment indicator 134 abuts the service line and is parallel to it. To practice a standard flat service, connecting shaft 104 is swiveled such that it fits within the outline 126 provided on plate 102. To practice a spin serve, outline 128 is employed. For a slice serve, the tennis player swivels connecting shaft 104 such that it lies within outline 130. To practice a kick serve, the connecting shaft 104 and base area indicator 106 are attached to plate 102 at connector 124 such that connecting shaft 104 lies within outline 132.

The components are constructed such that plate 102 may be used with its obverse side or flipped over to its reverse side. For example, the observe side may be marked for use by a right-handed player serving into the right court and the reverse side marked for use by a left-handed player serving into the right court. The obverse side may be marked for use by a right-handed player serving into the left court and the reverse side for use by a left-handed player serving into the left court. The obverse side may be marked for use by a right-handed player serving into the right court and the reverse side marked for use by a right-handed player serving into the left court. The obverse side may be marked for use by a left-handed player serving into the right court and the reverse side marked for use by a left-handed player serving into the left court. When backhand court service markings are used, plate 102 is also aligned by alignment indicator 134.

With either embodiment, or other equivalent embodiments, a net 80 (see FIG. 2) may be employed, known in the art, of variable size depending on the skill of the tennis player and the distance the net is place from him or her, to stop balls served, whether or not elastic 20.1 or 20.2 is employed in connection with the net. The net can aid both in ball retrieval and in preventing a ball connected by an elastic from returning too rapidly to the tennis player.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. An apparatus for training a tennis player to properly toss and strike a tennis ball on service, the apparatus comprising:

means defining a circular target base area for receiving a tennis ball when the tennis ball is properly tossed but not struck by a tennis player, said target base area having a diameter between approximately 150 mm and 500 mm;

means for positioning the feet of the tennis player relative to said target base area means;

a connecting member pivotally connecting said target base area means to said feet positioning means by a pivot means; and an imaginary vertical cylinder having a base thereof defined by said target base area means.

2. The apparatus of claim 1 further comprising means for anchoring said target base area to a tennis court.

3. The apparatus of claim 2 wherein said anchoring means comprise at least one protrusion extending from said target base area.

4. The apparatus of claim 3 wherein said at least one protrusion comprise a spike.

5. The apparatus of claim 3 wherein said at least one protrusion comprise a peg.

6. The apparatus of claim 1 wherein said positioning means comprise an elongate member, a plurality of means for foot alignment, and means for connecting each said foot alignment means to either side of said elongate member.

7. The apparatus of claim 6 wherein said elongate member comprises holes for connecting said elongate member and said plurality of foot-alignment means.

8. The apparatus of claim 6 wherein said plurality of foot-alignment means comprises at least one pair of shortened members.

9. The apparatus of claim 8 wherein there are at least two pairs of shortened members, said pairs being spaced apart along said elongate member, the members of each said pair being spaced apart so that a foot may be placed therebetween.

10. The apparatus of claim 6 wherein said foot-alignment means are spaced apart along said elongate member.

11. The apparatus of claim 6 wherein said elongate member is between approximately 500 mm and 1000 mm in length.

12. The apparatus of claim 6 wherein said elongate member includes means for weighting down said elongate member.

13. The apparatus of claim 12 wherein said elongate member is hollow and is fillable with sand.

14. The apparatus of claim 12 wherein said elongate member is hollow and is fillable with water.

15. The apparatus of claim 6 wherein said elongate member includes means for anchoring said elongate member to a tennis court.

16. The apparatus of claim 15 wherein said anchoring means comprise at least one protrusion extending from said elongate member.

17. The apparatus of claim 11 wherein said at least one protrusion is a spike.

18. The apparatus of claim 16 at least one protrusion is a peg.

19. The apparatus of claim 1 wherein said connecting member comprises holes to accommodate said pivot means.

20. The apparatus of claim 19 wherein said pivot means is removably insertable into each of said holes.

21. The apparatus of claim 1 wherein said connecting member is adjustable such that said target base area means and said positioning means are movable away from and towards each other.

22. The apparatus of claim 1 further comprising a tennis ball and for connecting the tennis ball to said target base area means.

23. The apparatus of claim 19 wherein said connecting means comprises an elastic cord.

24. The apparatus of claim 22 wherein said connecting means is adjustable to a length corresponding to the optimum service toss height of said tennis ball.

25. The apparatus of claim 22 wherein said connecting means is adjustable to a length permitting service of the tennis ball into a service court and return to a tennis player.

26. The apparatus of claim 1 wherein said positioning means comprises a single plate on which a tennis player stands.

27. The apparatus of claim 26 wherein said plate comprises means for indicating correct placement of a tennis player's foot.

28. The apparatus of claim 27 wherein said plate comprises additional means for indicating correct placement of the other foot of a tennis player.

29. The apparatus of claim 28 wherein said means for indicating correct placement of said other foot indicates a plurality of possible placements, the correct placement varying upon a tennis player's shoulder width.

30. The apparatus of claim 26 wherein said plate comprises means for indicating a correct position of said connecting member so as to correctly locate said target base area means for executing a predetermined serve of a tennis ball.

31. The apparatus of claim 30 wherein said predetermined serve is a flat serve.

32. The apparatus of claim 30 wherein said predetermined serve is a spin serve.

33. The apparatus of claim 30 wherein predetermined serve is a slice serve.

34. The apparatus of claim 30 wherein said predetermined serve is a kick serve.

35. The apparatus of claim 26 wherein said plate comprises means for indicating correct placement of said plate with respect to a service line of a tennis court.

36. The apparatus of claim 26 wherein said plate comprises an obverse side having means for indicating correct positionings for a right-handed service and a reverse side having means for indicating correct positionings for a left-handed service.

37. The apparatus of claim 26 wherein said plate comprises an obverse side having means for indicating correct positionings for a service into a right service court and a reverse side having means for indicating correct positionings for a service into a left service court.

38. The apparatus of claim 1 additionally comprising net means for stopping tennis balls served into said net means.

39. The apparatus of claim 1 additionally comprising means for removably attaching said connecting member.

40. The apparatus of claim 39 wherein said means for removably attaching when engaged is substantially flush with the surface of said target base area means.

41. An apparatus for training a tennis player to properly toss and strike a tennis ball on service, the apparatus comprising:

means defining a target base area for receiving a tennis ball when the tennis ball is properly tossed but not struck by a tennis player;

means for positioning the feet of the tennis player relative to said target base area means, said positioning means comprising a single plate on which a tennis player stands having an obverse side having means for indicating correct positionings for a right-handed service and a reverse side having means for indicating correct positionings for a left-handed service;

a connecting member connecting said target base area means to said feet positioning means; and an imaginary vertical cylinder having a base thereof defined by said target base area means.

42. An apparatus for training a tennis player to properly toss and strike a tennis ball on service, the apparatus comprising:

means defining a target base area for receiving a tennis ball when the tennis ball is properly tossed but not struck by a tennis player;

means for positioning the feet of the tennis player relative to said target base area means, said positioning means comprising a single plate on whcih a tennis player stands having an obverse side having means for indicating correct positionings for a service into a right service court and a reverse side having means for indicating correct positionings for a service into a left service court;

a connecting member connecting said target base area means to said feet positioning means; and an imaginary vertical cylinder having a base thereof defined by said target base area means.

* * * * *